United States Patent [19]

Ondrasik, II

[11] Patent Number: 4,651,713

[45] Date of Patent: Mar. 24, 1987

[54] SLIDE OUT RACK FOR OVENS AND THE LIKE

[76] Inventor: Vladimir J. Ondrasik, II, 11215 S. Wilmington Ave., Los Angeles, Calif. 90059

[21] Appl. No.: 818,084

[22] Filed: Jan. 13, 1986

[51] Int. Cl.[4] ..... F24C 15/16

[52] U.S. Cl. ..... 126/339; 126/337 R; 211/153

[58] Field of Search ..... 126/19 R, 337 R, 338, 126/339; 211/153; 312/346

[56] References Cited

U.S. PATENT DOCUMENTS

| | | | |
|---|---|---|---|
| 1,191,198 | 7/1916 | Kuhn et al. | 126/339 |
| 1,872,733 | 8/1932 | Greenwald | 126/337 R |
| 1,896,307 | 2/1933 | Hatch | 126/339 |

*Primary Examiner*—James C. Yeung

*Attorney, Agent, or Firm*—Brown, Martin, Haller & Meador

[57] ABSTRACT

A rack for forming a slide out support shelf in an enclosure such as an oven comprises an outer frame member defining the perimeter of the rack and having opposite front and rear limbs and opposite parallel side limbs, and a series of spaced parallel support members extending between and rigidly secured at their opposite ends to one of the pairs of opposite limbs of the outer frame member. The support members define a support surface of the rack and the rear limb of the frame member forms a stop member raised above the support surface when the rack is positioned in the enclosure with the side arms engaging above opposed guide ribs on opposite side walls of the enclosure. The side limbs have integrally formed rearwardly projecting and downwardly inclined hook-like projections for engaging over the guide ribs to prevent the rack from tilting and from pulling all the way out.

3 Claims, 5 Drawing Figures

FIG. 2
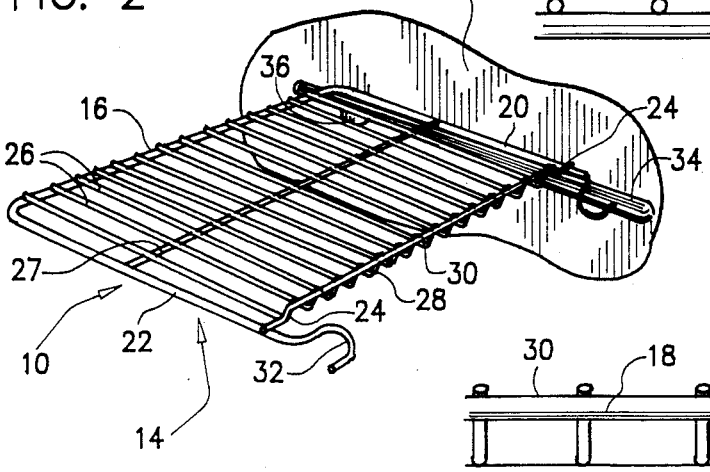
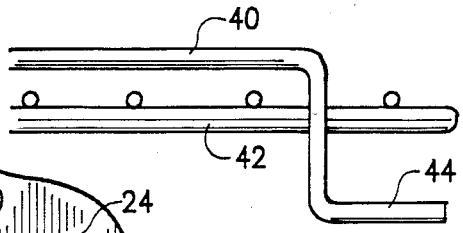
FIG. 1
PRIOR ART
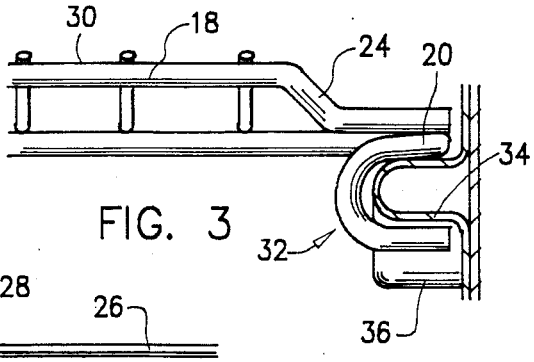
FIG. 3
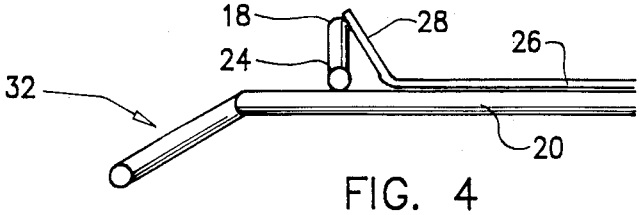
FIG. 4
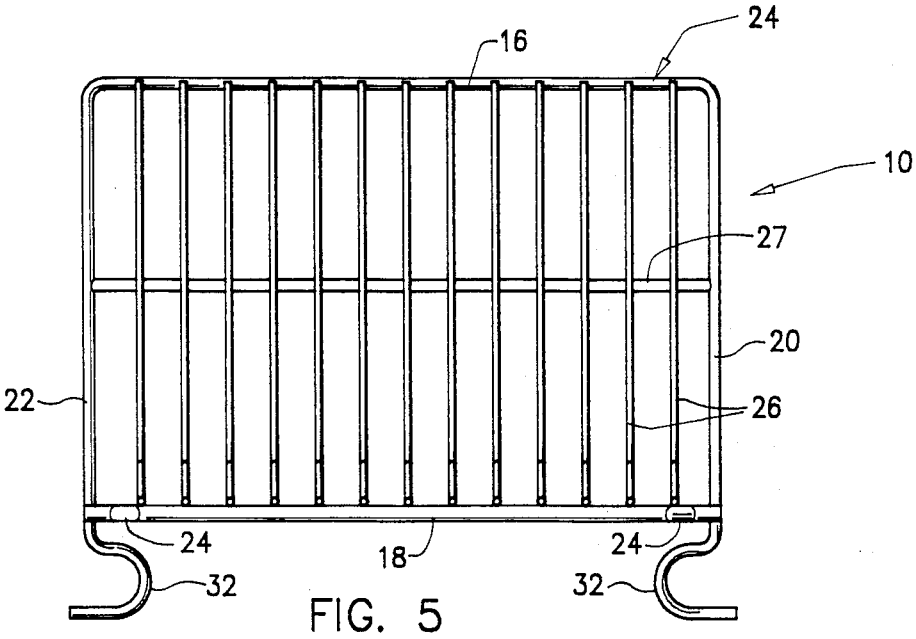
FIG. 5

SLIDE OUT RACK FOR OVENS AND THE LIKE

BACKGROUND OF THE INVENTION

The present invention relates to slide out racks or shelves of metallic construction used for supporting objects in enclosures such as ovens, refrigerators, cupboards and the like.

Oven racks are generally of wire frame construction and are designed to slide over horizontal ribs at spaced heights in the opposite side walls of the oven so that they can be removed for cleaning or for replacing at a different height for a faster or slower cooking time. The racks are generally rectangular, with a surrounding peripheral frame and a series of spaced parallel support rods or wires extending between two opposite sides of the frame. The spaced wires form a support surface for food and other articles placed on the shelf or rack, and may extend from the front to the rear or between opposite sides of the oven when the rack is in place. Normally a raised stop bar is provided at the rear of the shelf to prevent articles such as pots, pans, dishes, plates and the like from being pushed too far onto the shelf. Downwardly angled hooks are also often provided at the rear end of the rack for positively engaging around the oven ribs for added stability of the rack to prevent it from tipping when the weight of articles placed on the rack is unevenly distributed. Such hooks are normally arranged to engaged suitable stops on the guide ribs as the rack is being removed from the oven to prevent the rack from being pulled straight out of the oven. Normally the forward end of the rack must be raised to allow the hooks to slide over the stops, which are generally in the form of thickenings of the ribs such as bumps or ridges on the lower side of the ribs. Refrigerator shelves are normally of similar construction.

One problem in such racks is providing sufficient rigidity to support an average weight of articles while not adding too much weight to the construction to make it both cumbersome to handle and relatively expensive. Where a stop bar is added to the rear of the rack this is normally an extra rod welded across the rear part of the peripheral frame member, which adds to the weight, expense and complexity of the construction.

In one prior art construction of this type the rack comprises an outer frame member of rectangular shape, and a series of parallel support rods or wires extending from opposite front and rear limbs of the frame member to form a support surface. The side limbs of the frame member engage over guide ribs in the side walls of the oven, and a raised stop bar extends between the opposite side arms at the rear of the frame. The stop bar is formed with hook like projections at its opposite ends which project below the level of the side arms such that when the rack is in position in the oven the opposite guide ribs are engaged between the respective side arm and hook like projection to add strength to the shelf and restrict its sliding movement out of the oven. Even when the shelf is pulled slightly out of the oven the support surface will still be relatively stable due to the hooks engaging under the guide ribs to prevent the rear end of the rack from pivoting upwards due to the weight of the rack and anything supported on the rack.

This known rack construction requires the addition of an extra member at the rear of the rack to form the stop bar and retaining hooks, adding to the amount of material required in the rack construction and thus increasing the cost.

SUMMARY OF THE INVENTION

According to the present invention an improved rack is provided for forming a slide out support shelf in an enclosure such as an oven or refrigerator having opposite side ribs over which the rack engages. The rack comprises an outer frame member defining the outer perimeter of the rack with parallel opposite side limbs and parallel front and rear limbs, and a series of spaced parallel support members extending between one of the opposite pairs of limbs of the outer frame member and rigidly secured at opposite ends to those limbs. The support members form a support surface for supporting articles on the rack when positioned in the enclosure, and in the preferred embodiment of the invention they extend between the front and rear limb of the frame.

According to the present invention the side limbs are each formed with an integral rearwardly projecting hook, which projects rearwardly and downwardly to engage over a support rib in the enclosure when the rack is in place. When positioned the side limbs of the rack rest on the opposite guide ribs at the chosen height in the enclosure, and the hooks will project downwardly to engage around the contour of the rib at the rear of the enclosure. This provides additional stability to the rack without significantly adding to the material required or the complexity of the construction.

Preferably, the rear limb of the frame member is raised above the level of the support surface so that the rear limb itself forms a stop bar which restricts rearward movement of articles placed on the rack when the rack is positioned in the enclosure. The support members are bent upwardly adjacent their rear ends to meet with and be secured to the raised rear limb. Thus a stop bar is provided integrally with the rear limb of the frame member and without requiring an additional member.

The hooks, which are provided integrally with the side limbs, will engage over the respective opposite support ribs in opposite side walls of the enclosure when the rack is in place, so that it will remain stable when articles are placed on the support surface. As the rack is slid out of the enclosure the hooks will slide over the ribs so that the rack is relatively stable and restrained against rocking even when partially out of the enclosure. At the same time, since guide ribs in enclosures such as ovens and the like normally have stops in the form of thickened portions or bumps, the hooks will engage the stops as the rack is being pulled out to prevent the rack from being pulled completely out of the enclosure in a straight line direction. The forward end of the rack must be raised to allow the hooks to slide over such stops, so the rack is unlikely to be removed without first taking off any articles supported on it.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which:

FIG. 1 is rear view of part of the rear end of a prior art rack construction;

FIG. 2 is a perspective view of a rack according to a preferred embodiment of the present invention, showing the rack cooperating with a side rib at one side of a host enclosure;

FIG. 3 is a view similar to FIG. 1 showing an equivalent part of the rear end of the rack shown in FIG. 2;

FIG. 4 is a side elevational view of part of the rear end of the rack of FIG. 2; and FIG. 5 is a top plan view of the rack shown in FIG. 2.

DESCRIPTION OF THE PREFERRED EMBODIMENT

FIGS. 2 to 5 show a support rack 10 according to a preferred embodiment of the present invention for forming a shelf in an enclosure 12 such as an oven, refrigerator, freezer, dishwasher, or any similar appliance. The rack may also be used to provide a shelf in a display stand or other similar enclosure. Such racks are generally of metallic construction and may be of steel support wire or the like. However other materials of sufficient rigidity may be used. FIG. 1 illustrates part of a prior art rack for comparison purposes.

The support rack 10 basically comprises an outer frame member 14 forming the outer perimeter of the rack and having spaced parallel front and rear limbs 16,18 and spaced parallel side limbs 20,22. As shown in FIG. 2 the front limb and two side limbs are formed integrally from a single piece of bent wire or rod or the like, with the rear limb being formed separately and bonded by spot welding, soldering or similar techniques at opposite ends 24 to the opposite side limbs of the frame member. The frame member is preferably of rectangular outline as shown, but the shape and dimensions are chosen according to the horizontal cross-sectional dimensions and shape of the enclosure in which the rack is to be used.

A series of spaced parallel support members 26 extend between the front and rear limbs 16 and 18 and are rigidly secured at opposite ends to those limbs in a standard manner, such as by spot welding. The support members 26 define horizontal a support surface for supporting articles on the rack when it is positioned in a suitable enclosure. If the rack is of metal wire construction, the frame member will normally be of a heavier gauge than the support members, as indicated in the drawings.

One or more cross members 27 may be provided to extend across the support members 26 between the opposite side limbs 20 and 22 to add rigidity to the support surface and resist deformation of the support members. The cross member 27 is bonded to the side limbs and to the support members where it crosses them, for example by spot welding.

As can be seen in FIGS. 2 to 4, the rear limb 18 of the frame has bent or stepped portions adjacent its opposite ends to form a raised stop member 30 at the rear of the rack which is raised above the level of the support surface when the rack is positioned in an enclosure or other support. The support members 26 are bent upwardly at their rear ends 28 to meet with and be bonded to the raised portion of the rear limb 18, as can be seen in FIGS. 2 to 4.

Instead of forming the rear limb with bent end portions so that it is raised above the level of the support surface, the rear limb may be straight with the side limbs stepped upwardly relative to the front limb so that both the side limbs and the rear limb are positioned above the level of the support surface when the rack is placed in the enclosure. In this case the support members will still be formed with bent rear end portions to be secured to the rear limb.

Each of the side limbs 20,22 of the rack is formed with an integral, rearwardly projecting hook-like formation 32 which projects rearwardly beyond the rear limb 18 and downwardly below the level of the side limbs, as best seen in FIGS. 2 and 3. The purpose of the hook like formations 32 is best shown in FIG. 2. The rack is intended to engage over a chosen pair of horizontal guide ribs, one of which is illustrated at 34 in FIG. 2, which are provided at spaced heights in an enclosure such as an oven, refrigerator or the like. The rack is slid into the enclosure over the guide ribs at the chosen rack height, with the side limbs 20 and 22 resting on top of the ribs as indicated in FIG. 2.

The hook like formations 32 are designed to engage over the respective side ribs adjacent the rear of the enclosure when the rack is in position, as indicated in FIG. 2, so that each of the formations extends underneath the rib and helps to provide positive support for the rack in the enclosure. Thus the stability of the rack is improved and tipping of the rack is prevented even when weight is distributed unevenly on it or when it is pulled part of the way out of the enclosure. As best seen in FIGS. 3 and 4, the formations 32 are generally U-shaped to follow the rounded contour of the guide rib 34, and project downwardly at an angle of approximately 35 degrees to the side limbs 20 and 22.

In side rib constructions to support racks in ovens and the like, it is conventional to provide a thickened portion or bulge 34 close to the forward end of each rib, which acts as a stop to prevent the rack from sliding forwards off the ribs or from being pulled out in a straight line direction. Thus the rack must normally be raised at its forward end to avoid the stop when it is being removed from the oven, which ensures that any articles on the rack will be taken off prior to removal. In the rack constructed as shown in FIGS. 2 to 5, the hook like formations 32 will slide along the ribs as the rack is being removed from the enclosure, until they meet the bulges or stops 34, at which point the rack must be lifted at its forward end to allow the formations to slide over the bulges and release the rack from the enclosure.

The rack constructed as shown in FIGS. 2 to 5 of the drawings is of simple construction and requires less material than equivalent prior art constructions, such as constructions of the type illustrated in part in FIG. 1. In that construction a stop member 40 is provided in the form of an extra bar which extends along and above the rear limb 42 of the rack frame and which is bent downwardly at opposite ends to be secured to the rear limb by spot welding or the like. The stop member is provided with hook like formations 44 at its opposite ends, which project downwardly and outwardly from the point of connection to the rear limb 42. The formations 44 have a similar purpose to the hook like formations 32 of the above described embodiment of the present invention, but are of square rather than rounded configuration.

Thus the prior art construction uses more material and is of a more complex construction than the rack constructed as shown in FIGS. 2 to 5. The hook like formations according to the present invention are formed integrally with the side limbs of the rack, and the stop is formed by the rear limb of the rack so that no additional stop bar is needed. The rack 10 of FIGS. 2 to 5 can be easily constructed by first bending a wire or the like to form the front limb, side arms and hook like formations of the rack, then securing the rear limb at opposite ends to the side arms. The support members are then each bent upwardly at one end as shown in FIG. 4, and secured at their bent ends to the rear limb and at their opposite ends to the front limb, for example by spot welding, as shown in FIGS. 2 and 4. Thus each part of the rack performs multiple functions to reduce cost, increase manufacturing simplicity and reduce the overall weight of the rack.

Instead of the cross member 27 as shown in the drawings, the rack may be provided with raised side limbs and projections on the outer two support members to project below the side limbs, so that the guide ribs are positively gripped between the side and opposing projections, in the manner described in my U.S. Pat. No. 3,977,389.

Although a preferred embodiment of the invention has been described above by way of example, it will be understood by those skilled in the art of rack construction that modifications may be made to the disclosed embodiment without departing from the scope of the invention, which is defined by the appended claims.

I claim:

1. A rack for forming a support shelf for supporting articles in an enclosure, comprising:

a continuous, integral outer frame member forming a front limb and spaced side limbs perpendicular to the front limb;

a rear limb comprising an elongate member having a straight central portion, and stepped opposite end portions bonded to the side limbs at points spaced from the free ends of the side limbs, the central portion of the rear limb being raised above the plane defined by the outer frame member to form a stop member for restricting rearward motion of articles on the shelf;

the free ends of the side limbs being bent inwardly and back outwardly relative to the rest of the respective side limb to form U-shaped hooks which project rearwardly from the rear limb and lie in a plane at an angle of between 30 and 40 degrees to the respective side limbs and which have hook openings which face outwardly away from one another for engagement around locating ribs in an enclosure, the hook openings being substantially aligned with the respective side limb; and a series of spaced parallel support members extending between the front limb and the rear limb, the support members lying in the plane of the front and side limbs and being bent upwardly at their rear ends to meet the central portion of the rear limb, the bent rear ends being bonded to the central portion of the rear limb.

2. The rack as claimed in claim 1, including at least one cross member extending between the side limbs over the support members, the cross member being bonded to the side limbs and support members where it crosses them.

3. The rack as claimed in claim 1, wherein the rear limb comprises a straight central portion, downwardly inclined intermediate portions at each end of the central portion, and straight end portions below and parallel to the central portion which are bended to the respective opposite side limbs.

* * * * *